US011319653B2

(12) United States Patent
Papenfuβ

(10) Patent No.: US 11,319,653 B2
(45) Date of Patent: May 3, 2022

(54) DEVICE FOR MAKING POMPONS

(71) Applicant: William Prym GmbH & Co. KG, Stolberg (DE)

(72) Inventor: Andreas Papenfuβ, Weimar (DE)

(73) Assignee: William Prym GmbH & Co. KG, Stolberg (DE)

( * ) Notice: Subject to any disclaimer, the term of this patent is extended or adjusted under 35 U.S.C. 154(b) by 68 days.

(21) Appl. No.: 16/695,334

(22) Filed: Nov. 26, 2019

(65) Prior Publication Data

US 2020/0173071 A1 Jun. 4, 2020

(30) Foreign Application Priority Data

Nov. 30, 2018 (DE) ..... 20 2018 106 817.2

(51) Int. Cl.
*D04D 7/06* (2006.01)
*D04D 11/00* (2006.01)

(52) U.S. Cl.
CPC ..... *D04D 7/06* (2013.01); *D04D 11/00* (2013.01)

(58) Field of Classification Search
CPC .. D04D 7/06; D04D 7/04; D04D 7/08; D04D 7/10; D04D 7/00; D04D 11/00; D03D 29/00; D05B 35/08; D04B 3/00; D04B 3/06
USPC ..... 28/147, 149, 150; 223/46, 44
See application file for complete search history.

(56) References Cited

U.S. PATENT DOCUMENTS

| | | | | | |
|---|---|---|---|---|---|
| 779,614 | A * | 1/1905 | Loe | B65D 33/1675 | 24/30.5 R |
| 1,819,234 | A * | 8/1931 | Dolia | A41G 1/02 | 28/150 |
| 2,521,863 | A * | 9/1950 | Mertz | A41G 1/02 | 223/46 |
| 3,000,074 | A * | 9/1961 | Butkiewicz | D04D 7/06 | 28/147 |
| 3,110,077 | A | 11/1963 | Spear | | |
| 3,287,785 | A | 11/1966 | Ciroli | | |
| 3,413,699 | A | 12/1968 | Millay | | |
| D275,151 | S | 8/1984 | Okada | | |
| D323,975 | S * | 2/1992 | Wise | B65D 33/1675 | D8/396 |
| 6,655,559 | B2 | 12/2003 | Goldstein | | |
| 8,316,517 | B2 | 11/2012 | Fujiwara | | |

FOREIGN PATENT DOCUMENTS

| | | | | |
|---|---|---|---|---|
| CH | 87947 A * | 1/1921 | | D04D 11/00 |
| DE | 501237 C * | 6/1930 | | D04D 7/00 |
| DE | 3722854 A1 | 1/1989 | | |
| DE | 202018101029 U1 * | 3/2018 | | D04D 11/00 |
| JP | 3436751 B2 | 8/2003 | | |

OTHER PUBLICATIONS

U.S. Appl. No. 29/692,466, filed May 24, 2019.

* cited by examiner

*Primary Examiner* — Amy Vanatta

(74) *Attorney, Agent, or Firm* — Oppedahl Patent Law Firm LLC

(57) ABSTRACT

The new device for producing pompons comprises a ring carrier, which holds two winding disks in a holding region, wherein two half-ring-shaped disk halves together form a winding disk. Outside the holding area for the disc halves, the ring carrier has a handle. This handle can be grasped during the entire pompon production without hindering the winding process or the cutting.

14 Claims, 5 Drawing Sheets

DEVICE FOR MAKING POMPONS

BACKGROUND

For the production of pompons, annular wrapping templates are known in which the serving for pomping yarn is continuously wound around the resulting ring between the central hole and the periphery. In order to avoid having to pass yarn through the central hole, it is known from document DE 3 722 854 A1 to form the winding ring from two identical ring halves, which are movably connected to one another, for example via a hinge. The hinge allows a pivot, whereby the winding process is facilitated because each ring half can be wrapped in succession. The winding ring is closed only after the winding process to carry out the final assembly of the pompom, namely to cut the yarn at its periphery. With a fastening thread, a thread loop is generated, which holds the finished pompon together. In order to facilitate the cutting in the periphery, the winding rings are spaced by nubs, so that a gap is formed, a cutting tool is inserted into the gap and cut along the periphery of the yarn package. A similar device with winding rings of two ring halves is shown in the design patent U.S. Pat. No. 2,751,515 S. A disadvantage of the aforementioned known winding templates that during manufacture of the pompon, the two winding rings can move apart or move against each other, so that the winding rings are no longer aligned. If this happens, it is no longer possible to achieve a desired form-fitting pompon and the wrapping process must be restarted.

The document JP 3 436 751 B2 shows a possibility of keeping the two winding disks in a coupled state. For this purpose, a support device is present, which consists of two support elements. At each support member two semicircular ring elements are pivotally supported. For wrapping, the carrier elements are connected and the ring elements pivoted away from the carrier device to the outside. For cutting the pompom along the entire periphery, the support elements must be separated from each other. The aforementioned device is structurally complex. Moreover, this device can only make pompons of one particular size.

It is an object of the present invention to provide an improved apparatus for producing a pompon, which is particularly simple in construction and can make pompons of various sizes.

SUMMARY OF THE INVENTION

This object is achieved with a device having the features of claim 1. The dependent claims provide further advantageous features for such a device.

The new device for producing pompons comprises a ring carrier, which holds two winding disks in a holding region, wherein two half-ring-shaped disk halves together form a winding disk. Outside the holding area for the disc halves, the ring carrier has a handle. This handle can be grasped during the entire pompon production without hindering the winding process or the cutting.

The ring carrier is composed of two carrier elements, which are pivotally connected together at the handle end and at the other end via closure elements are connected to a releasable closure together, which then results in the holding area being a closed ring.

In an advantageous embodiment, the two pieces that make up the ring carrier are identical to each other. This allows a cost-effective production of the ring carrier. For example, if both carrier elements made of plastic by injection molding, only one tool for is needed for the injection molding.

Each support member has at the handle end a means for pivotal connection. In an advantageous embodiment, a through hole is provided at the handle end of the support elements. The through holes in the two support members are provided so that they are aligned in the assembled state of the support members and together give a hinge eye for a socket which is inserted into these through holes and allows a pivoting movement.

The carrier elements of the ring carrier are constructed so that they form a handle together at one end, namely the handle end, and extending from this handle end to each support member an arm. Closing elements are provided on the arm opposite the handle end, so that the two arms of the carrier elements can be connected to one another at this free end when the carrier elements are pivoted toward one another. In the closed position, the arms of the carrier elements form the holding area, which is located next to the handle. Preferably, the arms of the support elements are semicircular, so that an annular holding area is formed.

In a preferred embodiment, both arms of the carrier elements are designed such that they comprise two semicircular carrier layers arranged one above the other, wherein the carrier layers are not directly adjacent to one another, so that a gap exists between the carrier layers. In this way a gap is maintained during the winding process, and preferably knobs are arranged on the inner surfaces of the carrier layers, which ensure a constant distance of the carrier layers away from each other during the winding process.

On the arms of the support elements, semicircular disc halves are attached on both sides, which form a winding disk on both sides of the ring carrier yielding a closed ring carrier. For this purpose, a disc half is pushed onto the outside of the carrier layers of the two carrier elements in each case. The carrier elements of the ring carrier have for a secure hold of a disc half on the one hand a grip-side clamping gap and on the other hand a closure-side clamping gap, in which the respective lower or upper insertion edge of the disc half is inserted. Then the disc half is pressed onto the outside of the respective carrier layer. Here, the disc halves are held in an advantageous manner by clamping elements on the carrier layers of the ring carrier.

After assembling the four halves of the disc, the production of a pompon can be started. For this purpose, the ring carrier is brought into winding position, that is, the releasable closure between the two carrier elements is opened and, by winding yarn on the two arms of the carrier elements, a yarn package for the pompon is produced. When both halves of the ring carrier are wrapped in yarn, the carrier elements are pivoted toward one another and the closure parts are connected to one another. In this closed position, the yarn package can be sliced along the periphery of the winding disks. After this, a fastening thread may be securely inserted into the existing gap.

After making a pompon, other pompons of the same size can be made with the device. Furthermore, it is possible to produce pompons of a different size with the same ring carrier. For this purpose, the four half-ring-shaped disc halves may be removed and replaced by disc halves of a larger or smaller diameter. In this way, pompons of different diameters can be produced with a ring carrier together with a plurality of sets of winding disks.

The new device for producing pompons can thus be used in a way that permits the production of pompons of various sizes. It is also advantageous that the device consists of a few individual parts that are easy to install. In addition, when manufacturing the pompons, there are no problems with shifting of winding disks, and the handling of the apparatus during the production of the pompons is easy. Advantageously, it is ensured by the closure on the ring carrier that when slicing the yarn package, the threads of the yarn package are firmly held together. In addition, the wide gap between the carrier layers of the carrier elements of the ring carrier and thus between the winding discs allows a clear guide for the scissors during the slicing process. In addition, handling is facilitated because the new device has a ring carrier with a handle outside the holding area of the winding disks.

Further measures and advantages of the invention are set forth in the description below. The invention is directed to all that is apparent from these new features.

DETAILED DESCRIPTION

Figure 1:
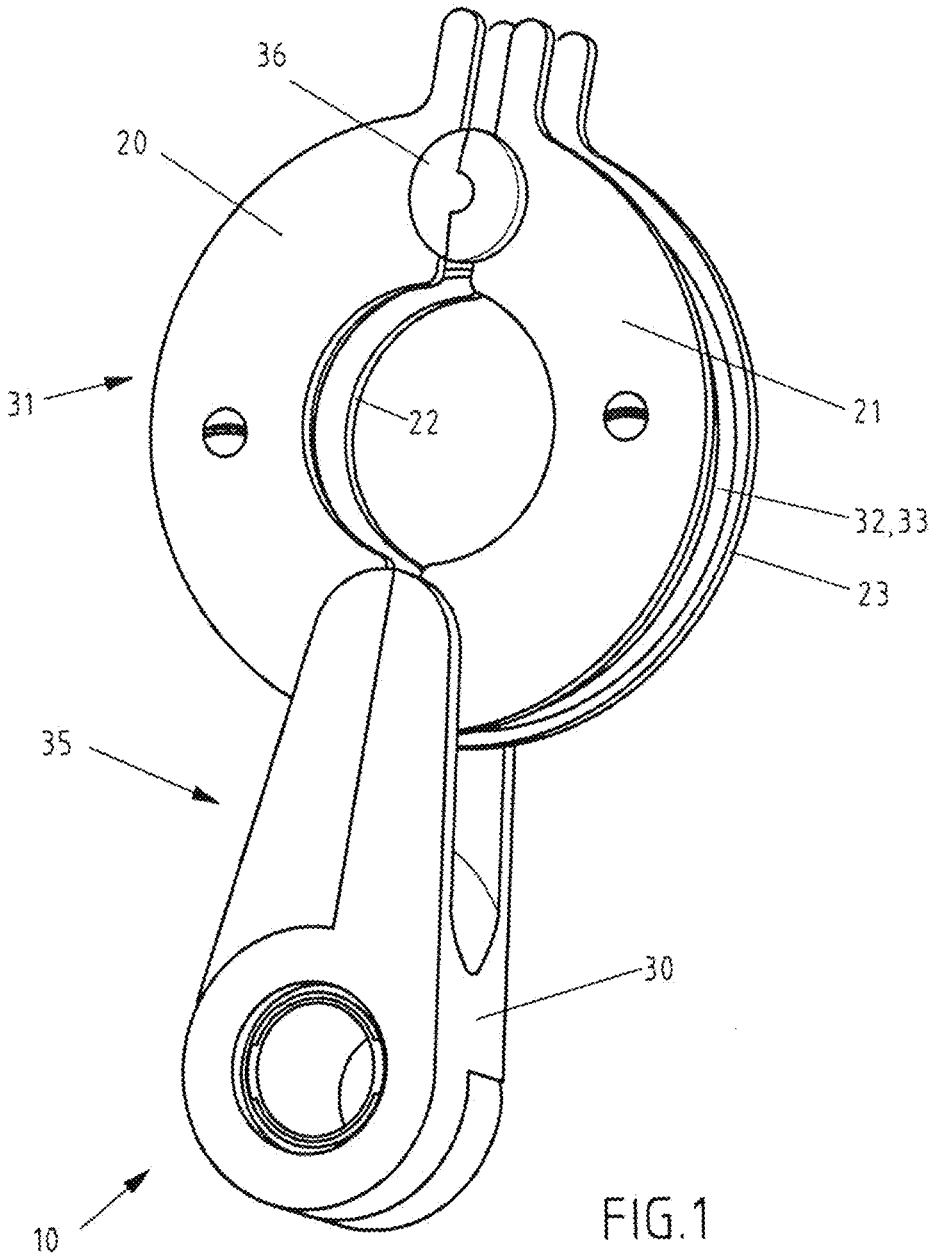
FIG. 1 is a perspective view of the device for producing pompons in the closed position.
Figure 4:
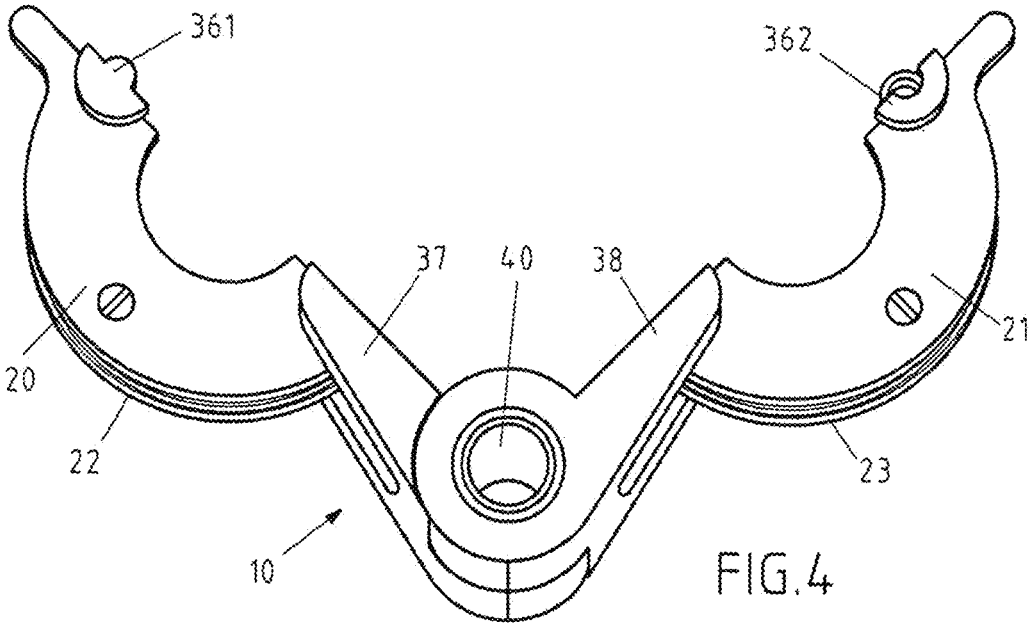
FIG. 4 is a perspective view of the device of FIG. 2 in the open winding position.
Figure 10:
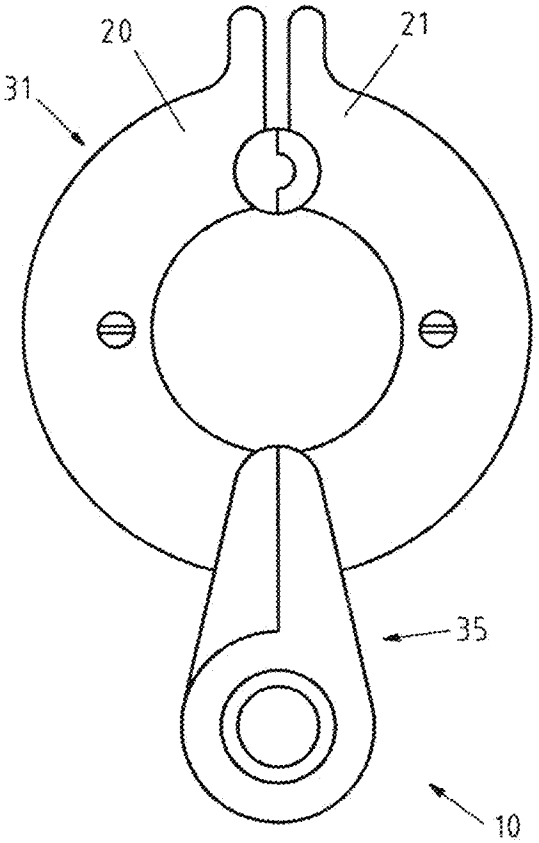
FIG. 10 is a plan view of the apparatus for producing pompons according to FIG. 1 with disk halves according to FIG. 3.

FIG. 1 shows the new device 10 for the production of pompons, which comprises the ring carrier 30 and in the holding region 31 we see the winding disks, namely a winding disk on the front and a winding disk on the back of the ring carrier 30. Here, the winding disks are each composed of two semi-annular disk halves, namely the front winding disk of the disk halves 20, 21 and the rear winding disk from the disk halves 22, 23. The ring carrier 30 has outside the holding portion 31 for the disk halves 20, 21, 22, 23 a handle 35. By means of the handle 35, the device 10 can be well positioned in both the closed position shown in FIGS. 1 and 10 and in the open position shown in FIG. 4, without the handle 35 hindering handling in the manufacture of the pompons.

Figure 2:
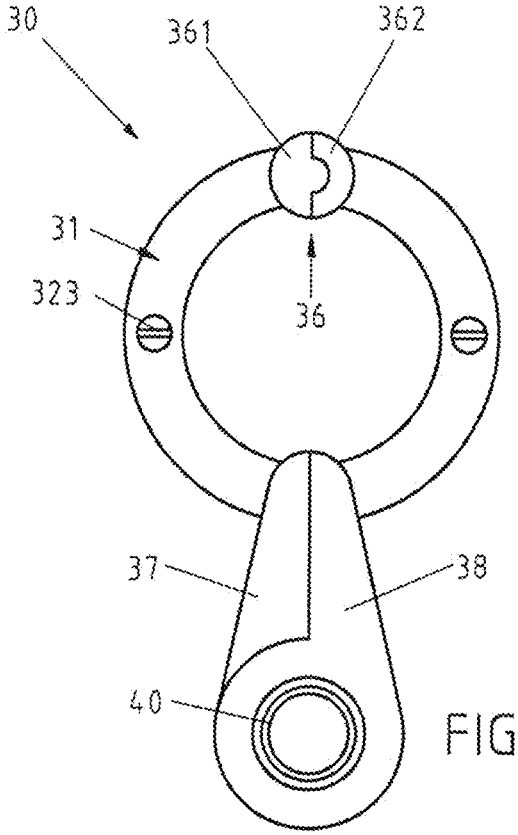
FIG. 2 is a plan view of the closed ring carrier of FIG. 1.

The ring carrier 30 consists in this embodiment, as better seen in FIG. 2, of two support members 37, 38. The support members 37, 38 are pivotally connected to each other at the handle end 351 and each have a semicircular arm. Both arms extend to the other, free end, where closure members 361, 362 are provided. By means of these closure parts 361, 362, the arms of the carrier elements 37, 38 can be connected together to form a releasable closure 36 and form an annular holding region 31.

The semicircular arms of the support members 37, 38 are configured in this example, that they comprise two superposed semicircular support layers 32, 33, wherein the upper support layer 32 is not immediately adjacent the lower support layer 33, but instead between the support layers 32, 33, a gap 34 is present. In order that the gap 34 is retained during the winding process, preferably nubs 326, 336 are arranged on the inner surfaces of the carrier layers 32, 33, which ensure a constant spacing of the carrier layers 32, 33 relative to one another during the winding process, see FIGS. 5 and 8.

Figure 5:
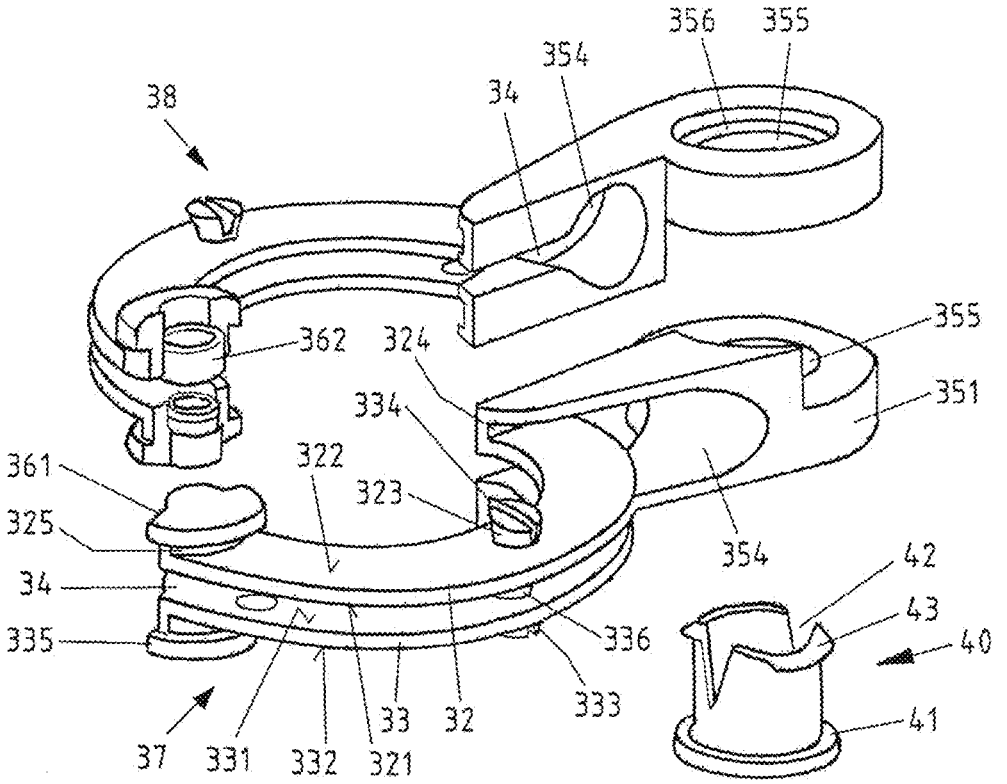
FIG. 5 is a perspective view of the parts of the ring carrier of FIG. 2.

In the advantageous embodiment shown, the two carrier elements 37, 38 are formed identically, as shown in FIG. 5, where the individual parts of ring carrier 30, namely, the two support members 37, 38 and sleeve 40 which connects them are shown prior to assembly. For assembly, the two support elements 37, 38 are stacked, wherein a support member is positioned in reverse orientation. The two support elements 37, 38 each have at the handle end 351 a through hole 355, which through holes are aligned after juxtaposition and result in a common through hole, which forms a hinge eye for the sleeve 40. To this sleeve 40, the support members 37, 38 are pivotally mounted when the device is assembled. The central axis of the sleeve forms the pivot axis. In this example, the sleeve 40 has a collar 41 which rests on a clamping edge 356 of the through hole 355 of the one support member 37. At the other end face of the sleeve 40, two hook-shaped clamping elements 43 are arranged, which are held on the clamping edge 356 of the other carrier element 38. The insertion of the sleeve 40 into the carrier element 37 and subsequently into the carrier element 38 is facilitated by the slot 42 in the sleeve. After mounting the sleeve 40, the support members 37, 38 are pivotally movable between an open position shown in FIG. 4 and a closed position shown in FIGS. 1 and 2.

Figure 7:
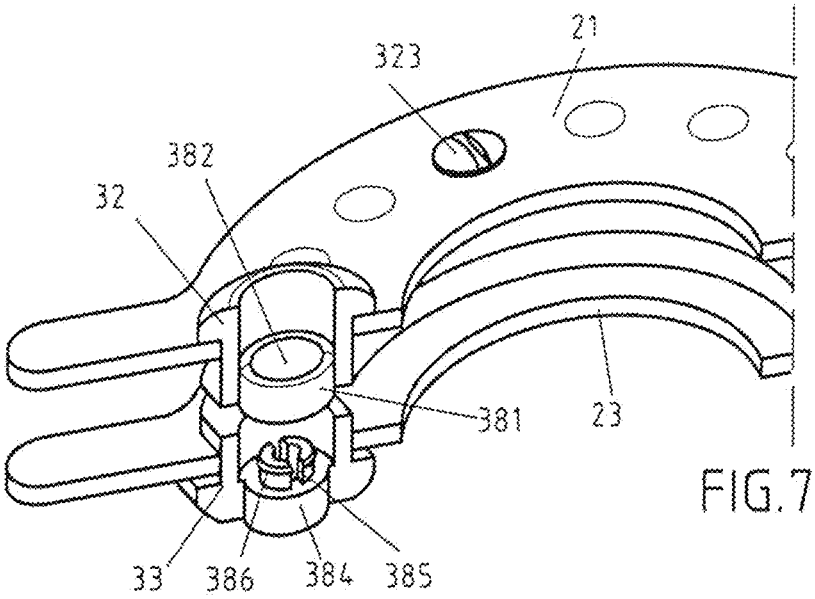
FIG. 7 is a perspective detail of the ring carrier of FIG. 2.
Figure 8:
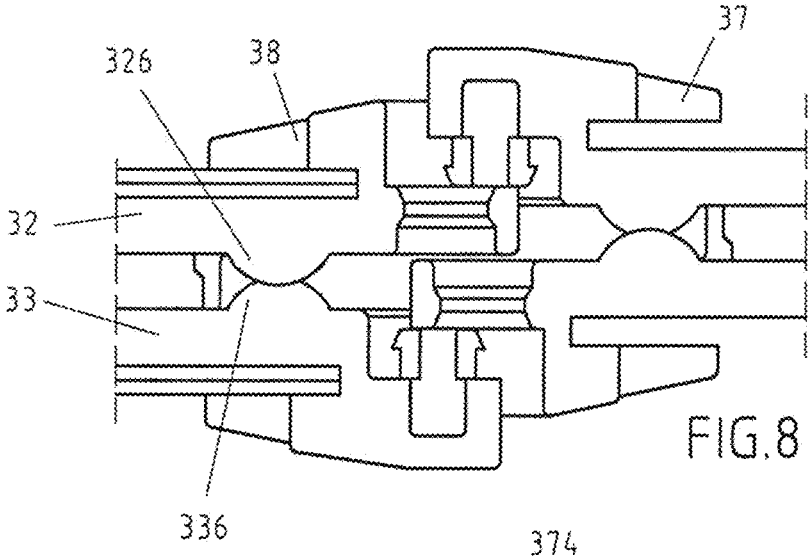
FIG. 8 is a sectional view of the ring carrier of FIG. 2 before closing.
Figure 9:
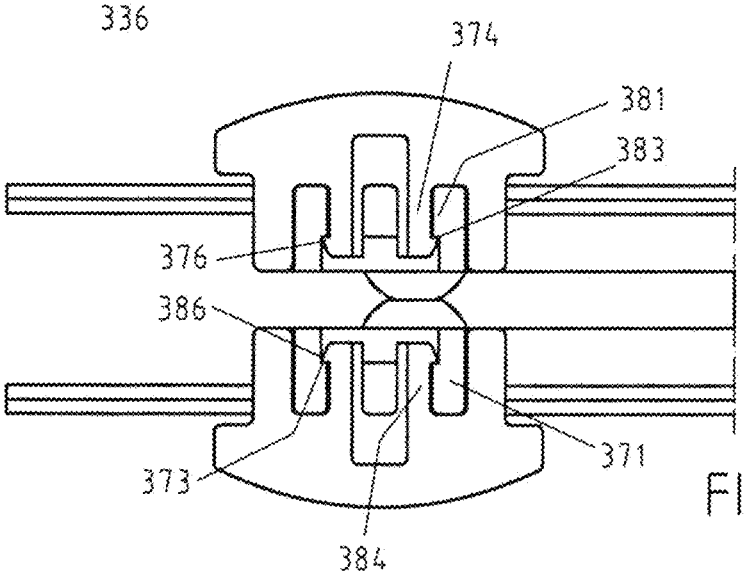
FIG. 9 is a sectional view of the ring carrier of FIG. 2 in the locked position.

For the closure 36, closure parts 361, 362 are provided on both carrier elements 37, 38. As best seen in FIGS. 7 to 9, both support elements 37, 38 have the same closure parts 361, 362, namely on the one hand a clamp receptacle 371, 381 and on the other hand a clamping bushing 374, 384. Since in the assembled position the one support member 37 is in reversed alignment with the other support member 38, thus the clamping receptacle 381 of the support member 38, which is located above the clamping bush 384, cooperates with the clamping bush 374 of the other support member 37, where the clamping bush 374 is located above. Furthermore, the clamping bush 384 located below in the carrier element 38 interacts with the clamping receptacle 371 of the carrier element 37 lying on top. When the closure elements 361, 362 of the support members 37, 38 are moved toward each other, the situation shortly before the connection is shown in FIG. 8. In the closed position, shown in FIG. 9, the clamping hooks 376 of the clamping bush 374 of the carrier element 37 engage behind a clamping edge 383 in the clamping receptacle 381 of the carrier element 38. Likewise, in the closed position of FIG. 9, the clamping hooks 386 of the clamping bush 384 of the carrier element 38 engage behind a clamping edge 373 of the clamping receptacle 371 of the carrier element 37.

Figure 3:
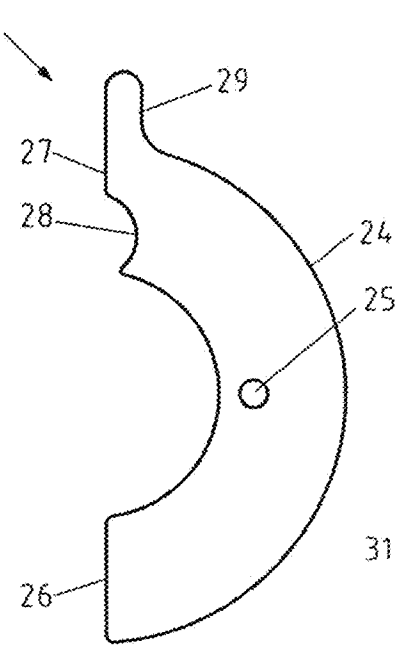
FIG. 3 is a plan view of a disc half of the winding disks of FIG. 1.
Figure 6:
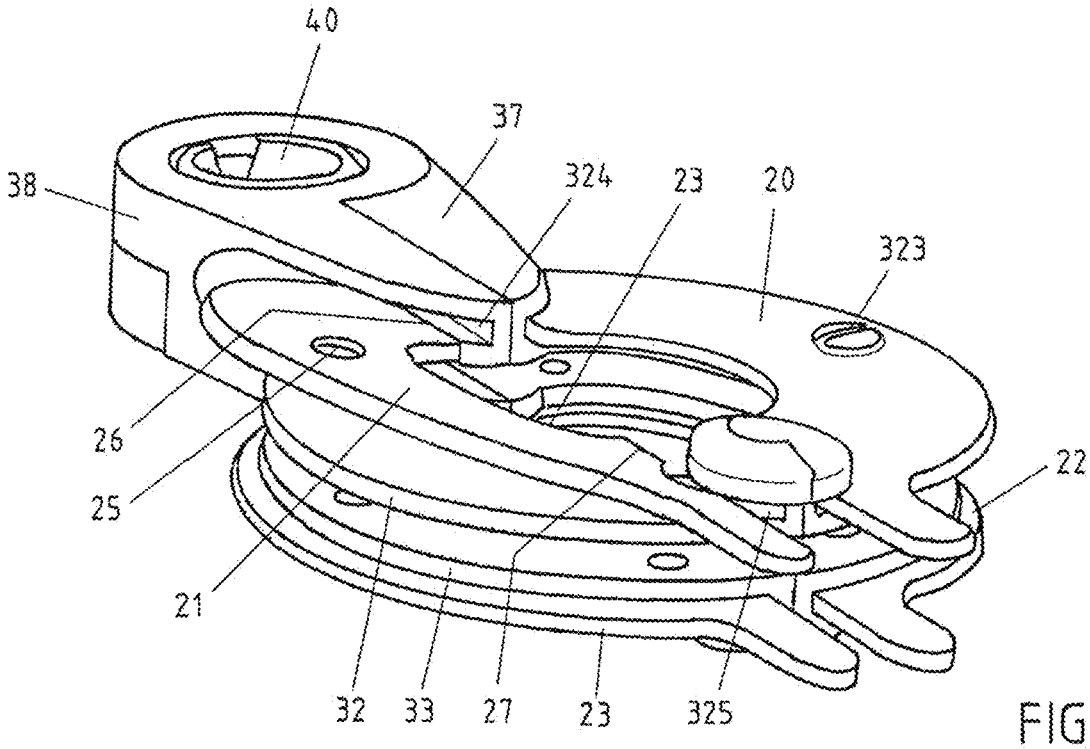
FIG. 6 is a perspective view of the device for the production of pompoms during assembly.

Semicircular disk halves 20, 21, 22, 23 can be attached to the ring carrier thus formed. Such a disk half is shown in FIG. 3. In the closed position, shown in FIGS. 1 and 10, the disc half 21 and the disc half 20 complement each other to form a winding disc, and its outer edge 24 gives the outer diameter of the winding disc. This outer diameter determines the size of the pompon to be produced. The disk halves 20, 21, 22, 23 are held on the ring carrier 30. For assembly, shown in FIG. 6, an annular disc 21 is inserted with its lower insertion edge 26 in a grip-side clamping gap 324 on the carrier element 38 and the upper insertion edge 27 in a closure-side clamping gap 325 on the same support member 38. Here, in this example, a recess 28 is provided on the disc halves 20, 21, 22, 23 in the region of the upper insertion edge. It represents an adaptation to the shape of the closure elements 361, 362 of the carrier elements 37, 38. After the insertion of the disc half 21, this is pressed onto the carrier layer 32 of the carrier element 38. In this case, a clamping element 323, which is located on the outer surface 322 of the carrier layer 32, engages in a suitable insertion hole 25 on the disc half 21, whereby the disc half 21 comes to bear against the carrier layer 32. In the same way, the other half disc 20 is mounted on the front side of the ring carrier 30 on the carrier element 37. The disc halves 22, 23 for the winding disc on the back of the ring carrier 30 are also inserted and fixed. Also on the rear side grip-side clamping gaps 334 for the lower insertion edge 26 and closure-side clamping gaps 335 for the upper insertion edge 27 and clamping elements 333 on the outside of the carrier layers 33 of the support elements 37, 38 are provided, see FIG. 5 and FIG. 6.

In FIG. 1, all disc halves 20, 21, 22, 23 mounted and the device 10 prepared for the preparation of the pompons. To produce the pompons, the closure 36 is now opened. For this purpose, one support element, for example the right support element 38, is pushed forward and the left support element 37 is pushed forward, as a result of which the closure 36 opens. The support elements 37, 38 are pivoted apart. They turn around the sleeve 40. The winding process can now begin. Equally, an arm of the support member 37 is fully wrapped from the handle to the closure 36. On the closure side, a tab 29 is provided on the disc halves, so that the closure is not wrapped. The thread end is secured and then the arm of the other support member 38 of the device 10 is wrapped in the same manner and secured here the thread end. The ring carrier 30 is now closed again. With a slicing tool, such as a pair of scissors, the yarn that has been wound onto the disc halves is sliced in its periphery. Here, the scissors engages in the gap 34 between the winding discs, formed from the disc halves 20, 21 and 22, 23. This gap 34 is effected by the distance between the carrier layers 32, 33 of the ring carrier 30. Through this gap 34, the scissors during slicing of the yarn package is securely guided, namely, from the closure 36 to the handle 35. In the region of the handle 35 of the ring carrier 30, a gap widening 354 is additionally provided in the carrier elements 37, 38, see FIG. 5, so that the scissors are securely guided far into the grip area during separation. After separation, a double fastening thread is placed all around in the gap 34, pulled together and knotted. After the slicing of the yarn, the gap 34 is opened. The distance between the inner surfaces of the carrier layers 32, 33 is maintained by the nubs 326, 336. These nubs 326, 336 have the further advantage that when tightening the fastening thread a clicking sound is caused, namely when the fastening thread is pulled through the nubs 326, 336. This sound indicates that the fastening thread is in the correct position and can be knotted. Thereafter, the ring carrier 30 is opened and the pompon is obtained.

Figure 11:
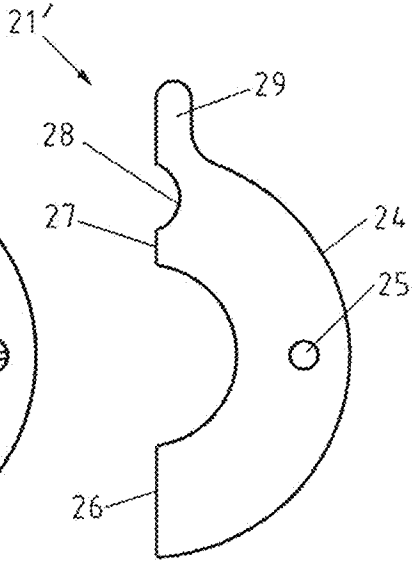
FIG. 11 is a plan view of a disc half for a smaller winding disk.
Figure 12:
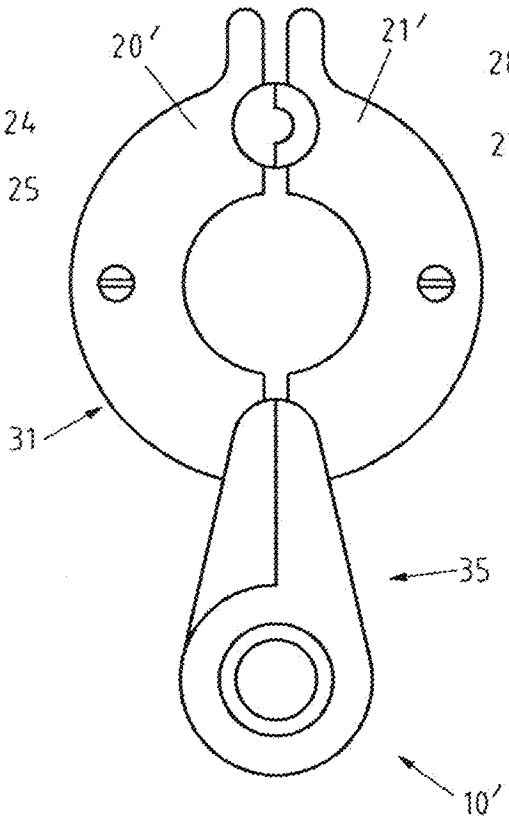
FIG. 12 is a plan view of the device for producing pompons with disc halves of FIG. 11.

Advantageously, as described above, the four disc halves 20, 21, 22, 23 with a first outer diameter of, for example, 9 cm, shown in FIG. 3, can be mounted on the ring carrier 30 shown in FIG. 3. But then it is also possible, for example, to make a smaller pompon, by using the same ring carrier 30 with four pulley halves 21' each smaller in its outer diameter, for example, 7 cm. To change the size of the pompon, the disc halves 20, 21, 22, 23 can be easily detached from the ring carrier 30, namely the disc halves 20, 21, 22, 23 raised at the outer edge and pulled out of the clamping gaps 324, 334, 325, 335 and then disc halves 21' of a smaller diameter, shown in FIG. 11, are mounted on the ring carrier 30. This then results in a device 10', shown in FIG. 12.

The individual parts of the device, in particular of the ring carrier 30, are preferably made of plastic. The disc halves 20, 21, 22, 23 may also be made of plastic, but may also be made of other materials such as cardboard. They can be colored and printed. In the case of several sets of disc halves 20, 21, 22, 23 for a ring carrier 30, it is advantageous to make the disc halves 20, 21, 22, 23 of the same size using color to indicate the size. According to the shape of the disc halves 20, 21, 22, 23, in particular round pompons are produced. However, the disc halves 20, 21, 22, 23 may also be shaped in other shapes, so as to be of the same or different diameter as templates for example to serve for different animal heads or such.

LIST OF REFERENCE NUMBERS

10, 10' device, pompom maker
20, 21, 22, 23 disc half
21' half disc
24 outer edge
25 insertion
26 lower insertion edge
27 upper insertion edge
28 recess
29 tab
30 ring-bearer
31 holding area
32, 33 carrier layer
321, 331 inner surface
322, 332 outer surface
323, 333 clamping element
324, 334 grip-side clamping gap
325, 335 closure-side clamping gap
326, 336 nubs
34 gap
35 handle
351 handle end
354 widening gap
355 through hole
356 clamping edge
36 closure
361 connecting part
362 connecting member
37, 38 carrier element
371, 381 clamp receiver
372, 382 insertion opening
373, 383 clamping edge
374, 384 clamping bush
375, 385 slot
376, 386 clamping hook
40 jack
41 collar
42 slot
43 hook-shaped clamping element

The invention claimed is:

1. An apparatus for producing pompons comprising a ring carrier (30) with two winding discs in a holding region (31), wherein two semi-annular disc halves (20, 21, 22, 23) each form a winding disc, characterized, in that the ring carrier (30) comprises a handle (35) outside the holding region (31) for the semi-annular disc halves (20, 21, 22, 23), wherein the ring carrier (30) is constructed of two carrier elements (37, 38), which are pivotally connected together at one end forming a handle end (351) and which have a closure part (361, 362) for a releasable closure (36) at the other end, further characterized in that each carrier element (37, 38) has an arm of two superimposed, semicircular carrier layers (32, 33), wherein each carrier layer (32, 33) releasably holds one of the semi-annular disc halves (20, 21, 22, 23).

2. The apparatus according to claim 1, characterized in that the two carrier elements (37, 38) are formed identically, wherein one of the carrier elements (37) is pivotally connected in an inverted orientation with the other carrier element (38).

3. The apparatus according to claim 1, characterized in that the two carrier elements (37, 38) have a through hole (355) at the handle end (351) and both through holes (355) together form a hinge eye for a bushing (40), wherein the central axis of the bushing (40) is a pivot axis of the handle.

4. The apparatus according to claim 1, characterized in that a gap (34) is present between the carrier layers (32, 33) of each pair of carrier elements (37, 38).

5. The apparatus according to claim 4, characterized in that each semi-annular disc half (20, 21, 22, 23) has a lower insertion edge (26) in a grip-side clamping gap (324) of a carrier element (37, 38) and has an upper insertion edge (27) held in a closure-side clamping gap (324) of the same carrier element (37, 38).

6. The apparatus according to claim 4, characterized in that for detachable mounting of each semi-annular disc half (20, 21, 22, 23) on the outside of the carrier layer (32, 33) at least one clamping element (323, 333) is arranged, into which a corresponding insertion hole (25) of the semi-annular disc half (20, 21, 22, 23) engages.

7. The apparatus according to claim 5, characterized in that at the upper insertion edge (27) of one or more semi-annular disc halves (20, 21, 22, 23) beyond the closure-side clamping gap (325, 335) a tab (29) is extended outwardly, which serves to limit a winding area.

8. The apparatus according to claim 4, characterized in that the carrier layers (32, 33) have inner surfaces (321, 331), on which nubs (326, 336) are provided.

9. The apparatus according to claim 4, characterized in that the gap (34) between the semicircular carrier layers (32, 33) terminates by widening (354) at the handle end of the carrier elements (37, 38).

10. The apparatus according to claim 1, characterized in that on the two carrier elements (37, 38) complementary closure parts (361, 362) are provided.

11. The apparatus according to claim 10, characterized in that the two carrier elements (37, 38) have an insertion opening (372, 382) and a clamping bushing (374, 384), wherein the insertion opening (372) of one of the carrier elements (37) cooperates with a clamping bushing (384) of the other carrier element (38) and the clamping bushing (374) of the one carrier element (37) cooperates with the insertion opening (382) of the other carrier element (38).

12. The apparatus according to claim 1, characterized in that the ring carrier (30) holds winding discs of semi-annular disc halves (20, 21, 22, 23) of a first diameter, or after their removal has winding discs from semi-annular disc halves (20, 21, 22, 23) of a different diameter or of a different shape.

13. The apparatus according to claim 1, characterized in that the ring carrier (30) is comprised of plastic.

14. The apparatus according to claim 1, characterized in that the semi-annular disc halves (20, 21, 22, 23) are made of plastic or cardboard and the semi-annular disc halves (20, 21, 22, 23) are of a color other than black or white or gray.

* * * * *